US009714623B2

(12) United States Patent
Hahn

(10) Patent No.: US 9,714,623 B2
(45) Date of Patent: Jul. 25, 2017

(54) METHOD AND DEVICE FOR REGULATING AN AIR-FUEL RATIO OF AN INTERNAL COMBUSTION ENGINE

(71) Applicant: Volkswagen AG, Wolfsburg (DE)

(72) Inventor: Hermann Hahn, Hannover (DE)

(73) Assignee: VOLKSAWAGEN AKTIENGESELLSCHAFT, Wolfsburg (DE)

( * ) Notice: Subject to any disclaimer, the term of this patent is extended or adjusted under 35 U.S.C. 154(b) by 267 days.

(21) Appl. No.: 14/360,749

(22) PCT Filed: Nov. 27, 2012

(86) PCT No.: PCT/EP2012/073690
§ 371 (c)(1),
(2) Date: May 27, 2014

(87) PCT Pub. No.: WO2013/079468
PCT Pub. Date: Jun. 6, 2013

(65) Prior Publication Data

US 2015/0096544 A1 Apr. 9, 2015

(30) Foreign Application Priority Data

Nov. 28, 2011 (DE) ..... 10 2011 087 213

(51) Int. Cl.
*F02D 41/00* (2006.01)
*F02D 41/14* (2006.01)

(52) U.S. Cl.
CPC ..... *F02D 41/1444* (2013.01); *F02D 41/1454* (2013.01); *F02D 41/1479* (2013.01); *F02D 41/1487* (2013.01)

(58) Field of Classification Search
CPC ..... F02D 41/1444; F02D 41/1479; F02D 41/1487; F02D 41/1454; F02D 41/222
See application file for complete search history.

(56) References Cited

U.S. PATENT DOCUMENTS

2008/0110234 A1* 5/2008 Odendall ..... F02D 41/222 73/1.06

FOREIGN PATENT DOCUMENTS

CN 102200063 A 9/2011
CN 102239322 A 11/2011
(Continued)

OTHER PUBLICATIONS

International Search Report issued for PCT application PCT/EP2012/073690, mailed Mar. 21, 2013.
(Continued)

*Primary Examiner* — Kevin Lathers
(74) *Attorney, Agent, or Firm* — Pearl Cohen Zedek Latzer Baratz LLP

(57) ABSTRACT

The invention relates to a method and to a regulating device for regulating an air-fuel ratio of an internal combustion engine (10), wherein an exhaust-gas composition of an exhaust gas of the internal combustion engine (10) is determined by virtue of an actual probe signal, which is dependent on the exhaust-gas composition, being detected by means of an exhaust-gas probe (22) and the exhaust-gas composition being determined as a function of the actual probe signal by means of a characteristic curve or a calculation rule, and wherein the determined exhaust-gas composition is compared with a setpoint value or a threshold value, the attainment or exceedance of which triggers a manipulation of the air-fuel ratio supplied to the internal combustion engine (10), wherein, in order to take into consideration at least one disturbance variable which affects the actual probe signal, a safety margin (ΔS) is defined which is applied to the characteristic curve or calculation rule, to the actual probe signal or to the setpoint value or threshold value. It is provided that an evaluation of a present accuracy of the at least one disturbance variable and/or of a
(Continued)

present influence of the at least one disturbance variable on the probe signal is performed, and the safety margin (ΔS) owing to the at least one disturbance variable is defined as a function of the evaluation.

20 Claims, 3 Drawing Sheets

(56) References Cited

FOREIGN PATENT DOCUMENTS

| | | | |
|---|---|---|---|
| DE | 196 29 552 | | 12/1997 |
| DE | 199 19 427 | | 11/2000 |
| DE | 100 36 129 | | 2/2002 |
| DE | 10133524 | A1 | 1/2003 |
| DE | 10 2007 015362 | | 10/2008 |
| DE | 10 2007 038487 | | 2/2009 |
| EP | 2 322 916 | | 5/2011 |

OTHER PUBLICATIONS

Office Action of Chinese Patent Application No. 201280058511.8, mailed Nov. 25, 2015.

* cited by examiner

METHOD AND DEVICE FOR REGULATING AN AIR-FUEL RATIO OF AN INTERNAL COMBUSTION ENGINE

CROSS-REFERENCE TO RELATED APPLICATIONS

This application is a National Phase Application of PCT International Application No. PCT/EP2012/073690, International Filing Date Nov. 27, 2012, claiming priority to German Patent Application No. 10 2011 087 213.2, filed Nov. 28, 2011, both of which are hereby incorporated by reference in their entirety.

FIELD OF THE INVENTION

The invention relates to a method for regulating an air/fuel ratio of an internal combustion engine as a function of a composition of its exhaust gas and a correspondingly configured control device.

BACKGROUND OF THE INVENTION

It is known to perform open-loop or closed-loop control on internal combustion engines as a function of a composition of their exhaust gases, wherein the corresponding exhaust gas component is measured by means of a suitable exhaust gas probe. In particular the air/fuel ratio with which the engine is operated is regulated by measuring the oxygen content of the exhaust gas by means of a lambda probe in the exhaust gas section. This procedure is generally referred to as lambda control. In this case, the lambda probe makes available an actual probe signal which is dependent on the oxygen content of the exhaust gas and which is usually a probe voltage. This probe signal is converted into the lambda value by means of a stored characteristic curve or a corresponding calculation rule, and said lambda value is used for the regulating process.

However, conversion of the probe signal into a lambda value is in practice made more difficult by the fact that the probe signal not only depends on the exhaust gas composition but is also influenced by additional interfering influences which have the effect that the characteristic curve is not constant under all conditions. In the case of step-change probes, it is known, for example, that the probe temperature, that is to say the temperature of the measuring element of the probe, has an influence on the accuracy level of the conversion rule or of the characteristic curve. This has an effect, in particular, in the rich lambda range, that is to say at lambda values <1. In addition, changes in the characteristic curve characteristics result through increasing aging of the measuring element of the probe over the service life. Furthermore, various exhaust gas components such as lead, manganese, phosphorus or zinc can cause progressive contamination of the measuring element and therefore a change in the characteristic curve.

DE 100 36 129 A discloses compensating influences of the temperature on the probe signal. For this purpose, the probe temperature is determined as a function of the internal resistance of the probe from a stored characteristic curve. By using a three-dimensional characteristic diagram which maps a correction voltage as a function of a current probe actual voltage and the previously determined probe temperature, the current correction voltage is then determined and added to the current probe actual voltage in order to obtain a corrected probe voltage.

DE 199 19 427 A describes a method for correcting a characteristic curve of a broadband lambda probe which is installed upstream of an exhaust gas catalytic converter, wherein in an overrun shutoff phase of the internal combustion engine the sensor signal of the lambda probe is evaluated and the signal level which is determined in this way is used for the correction of the gradient of the characteristic curve.

DE 10 2007 015 362 A discloses a method for calibrating a step-change lambda probe which is arranged upstream of a catalytic converter. For this purpose, a correction signal is determined from a measurement signal which is made available by a reference lambda probe connected downstream, and said correction signal is used to adapt the characteristic curve of the step-change lambda probe.

It is disadvantageous with all the known methods that the corrections also only have a limited accuracy level and therefore deviations of the corrected characteristic curve from the exact characteristic curve can remain. This fact is taken into consideration in the prior art by defining lambda setpoint values or lambda threshold values which are to be adjusted and whose attainment triggers a change in the air/fuel mixture with a safety interval which takes into account the uncertainty. This safety interval is usually dimensioned in such a way that the largest degree of inaccuracy to be assumed for the characteristic curve is also taken into account.

A typical example of this procedure is the enrichment of an engine, which enrichment is performed to protect components against overheating. In this context, the combustion temperature and therefore the exhaust gas temperature are lowered by feeding in additional fuel, and overheating, for example of turbochargers or catalytic converters, is therefore prevented. The enrichment of the mixture in order to protect components is usually carried out when a permissible limiting temperature, for example of 900° C., is reached, wherein a target lambda value of for example 0.9 is set by feeding in additional fuel, said value ensuring an effective cooling effect. If, for example, a maximum tolerance range of 2% is allowed for when using the lambda probe, a lambda threshold of 0.88 is conventionally predefined for the engine in order to remain reliably under the necessary limit of lambda 0.9 under all conditions. However, in the majority of engines which have a lambda probe with relatively small tolerance deviation, this results in a relatively large amount of enrichment and consequently in a higher consumption of fuel than would be actually necessary.

SUMMARY OF THE INVENTION

The object of the present invention is therefore to provide a method and a device for regulating an air/fuel ratio of an internal combustion engine in which the safety interval to be maintained for threshold values for the exhaust gas composition, in particular for lambda threshold values, is defined according to actual requirements, and the fuel consumption is therefore reduced.

This object is achieved by a method for regulating an air/fuel ratio of an internal combustion engine and by a corresponding regulating device having the features of the independent claims.

The method according to the invention comprises the steps of:

determining the exhaust gas composition by detecting an actual probe signal, dependent on the exhaust gas composition, by means of an exhaust gas probe, and determining the exhaust gas composition by means of a characteristic curve or a calculation rule as a function of the actual probe signal, comparing the determined exhaust gas composition with a setpoint value or a threshold value, wherein in order to take into account at least one interference variable acting on the actual probe signal a safety interval is defined which is applied to the characteristic curve or calculation rule, to the actual probe signal or to the setpoint value or threshold value, and triggering influencing of the air/fuel ratio fed to the internal combustion engine, if the determined exhaust gas composition reaches the setpoint value or threshold value.

According to the invention, in this context a current accuracy level of the at least one interference variable and/or a current influence of the at least one interference variable on the probe signal are/is evaluated and the safety interval which is conditioned by the at least one interference variable is defined as a function of the result of the evaluation.

Whereas in the prior art the safety interval is therefore always defined as a constant, specifically at the level of its maximum value in a worst case scenario, according to the invention it is defined in a variable fashion. This permits the safety interval to be defined at the lowest value that the present situation permits, with respect to the target value which is to be actually complied with (for example the setpoint value or threshold value). The method therefore permits not only a relatively high accuracy level of the regulation of a setpoint value but also a saving in fuel.

The interference variable acting on the probe signal, which is evaluated within the scope of the invention, preferably comprises a temperature of the exhaust gas probe and/or aging of the exhaust gas probe and/or chemical contamination of the exhaust gas probe. The influence of these interference variables on the probe signal, in particular of lambda probes, is known in the prior art. However, as has already been described above, according to the invention, with respect to these interference variables, it is not their greatest possible uncertainty or their greatest possible influence on the probe signal which is assumed but instead said uncertainty/influence is evaluated on an up-to-date basis.

According to one preferred refinement of the invention, for the evaluation of the current accuracy level of the at least one interference variable, a variance is determined within which values of this interference variable lie, said values having been detected in a preceding time period. The safety interval is then defined as a function of the variance, it being self-evident that the safety interval selected is larger the larger the variance. If the interference variable is, for example, the temperature of the probe, the variance which the detected temperature values had from the true value is determined for a predetermined preceding time period. If only a small variance of the determined temperature was evident in the past, a small value can be correspondingly defined for the safety interval.

According to a further advantageous refinement of the invention, for the evaluation of the current accuracy level of the at least one interference variable, a period which has passed since a preceding calibration of a detection system for this interference variable is determined. The safety interval is then defined as a function of the period which is determined in this way, wherein a larger value is selected for the safety interval as the period becomes longer, since it is to be assumed that detection of the interference variable will become increasingly inaccurate. With respect to the example of the probe temperature as an interference variable this means that it is checked how long ago the last calibration of the detection of the temperature took place. If the detection of the temperature takes place, for example, by means of the internal resistance of the measuring element of the probe according to DE 100 36 129 A, it is determined when the last calibration of the characteristic curve of the temperature/internal resistance took place. In this context, the safety interval selected is larger the longer the time since the calibration took place.

In this context it is also possible to check whether in the past a need for calibration was detected but it has not yet taken place. In such a case, a high level of uncertainty of the currently determined interference variable is assumed and a correspondingly large value is defined for the safety interval.

According to a further advantageous refinement of the method, for the evaluation of the current influence of the at least one interference variable on the probe signal, an absolute magnitude of the currently detected interference variable is determined, and the safety interval is defined as a function of the absolute magnitude. If, for example, the absolute value of the internal resistance of the measuring element of the probe is in a range in which the temperature can be determined only very inaccurately, for example in the case of resistance values near to zero, it is assumed that there is a relatively large error of the determination of the temperature and a correspondingly large safety interval is defined.

According to a further refinement of the method, the safety interval is also defined as a function of an operating point of the internal combustion engine, in particular as a function of an engine speed and/or an engine load. For this purpose, it is possible to use a characteristic diagram which represents the safety interval as a function of the engine speed and/or the load. In this way it is possible to take into account influences which cannot be quantified in the evaluation.

The method can be particularly advantageously used in conjunction with the execution of mixture enrichment in order to protect components of the internal combustion engine and/or of the exhaust gas system against overheating. In this case, the predefined lambda value which is provided for the mixture enrichment is preferably defined in accordance with the method. In this context, the method permits the predefined lambda value defined for the protection of the components to be as lean as possible, that is to say with the smallest possible safety interval with respect to the target value, as a result of which the additional consumption of fuel which is to be incurred for the protection of the components is minimized.

Furthermore, the method according to the invention can advantageously also be used within the scope of the lambda control process of the internal combustion engine, wherein the lambda setpoint value which is to be adjusted is defined in the way according to the invention. Here, the invention permits particularly precise lambda control.

The invention also relates to a regulating device for regulating an air/fuel ratio of an internal combustion engine, which device is configured to carry out the method according to the invention in accordance with the description above.

Further advantageous refinements of the invention are the subject matter of the other dependent claims.

BRIEF DESCRIPTION OF THE DRAWINGS

The invention will be explained in more detail below in exemplary embodiments and with reference to the associated drawings, of which.

DETAILED DESCRIPTION OF THE INVENTION

Figure 1:
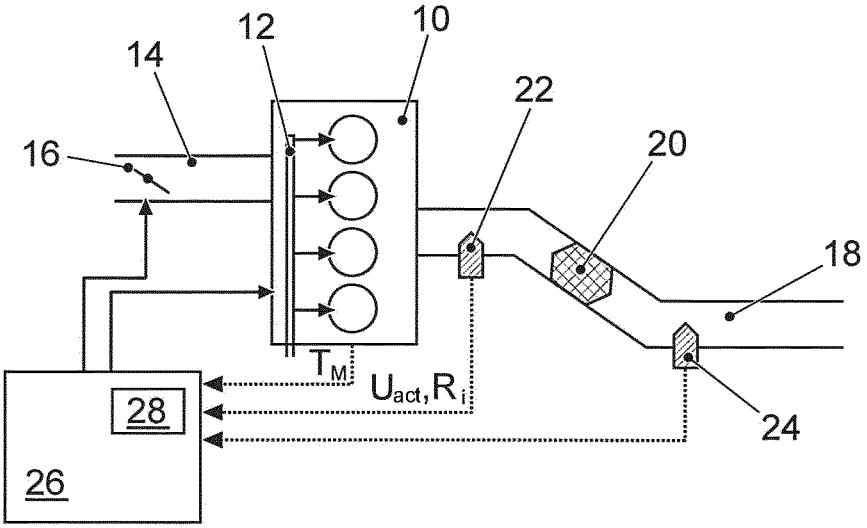
FIG. 1 shows an internal combustion engine having a regulating device according to the present invention.

FIG. 1 shows an internal combustion engine 10 whose fuel supply is provided via a fuel injection system 12. The injection system 12 can be an intake manifold injection system or a cylinder direct injection system. The internal combustion engine 10 is also supplied with combustion air via an intake manifold 14. If appropriate the quantity of air which is fed in can be regulated by means of a controllable actuating element 16, for example of a throttle valve, which is arranged in the intake manifold 14.

Exhaust gas which is generated by the internal combustion engine 10 is discharged into the surroundings via an exhaust gas duct 18, wherein exhaust gas components which are relevant environmentally are converted by a catalytic converter 20.

Arranged within the exhaust gas duct 18 at a position near to the engine is an exhaust gas probe 22, which is, in particular, a lambda probe, typically a step-change lambda probe. If appropriate, a further exhaust gas probe 24 can be arranged downstream of the catalytic converter 20, which further exhaust gas probe 24 can also be a lambda probe, in particular a broadband lambda probe, or an $NO_x$ sensor. The signals of the exhaust gas probes 22 and 24 are transmitted to an engine controller 26. Further signals of sensors which are not illustrated are also input into the engine controller 26. The engine controller 26 actuates various components of the internal combustion engine 10 in a known fashion as a function of the signals which are input. In particular, the air/fuel mixture which is to be fed into the internal combustion engine is regulated as a function of the probe signal $U_{act}$ (probe voltage) of the lambda probe 22 which is near to the engine, for which purpose the engine controller 26 regulates a quantity of fuel which is to be fed in via the fuel injection system 12 and/or a quantity of air which is to be fed in via the intake system 14. The engine controller 26 comprises a regulating device 28 which is configured to carry out the method according to the invention in order to regulate the air/fuel ratio of the internal combustion engine 10. For this purpose, the regulating device 28 contains a corresponding algorithm in a computer-readable form as well as suitable characteristic curves and characteristic diagrams.

The present method will be explained below using the example of the regulation of the engine in order to protect components against overheating, with reference to FIG. 2.

Figure 2:
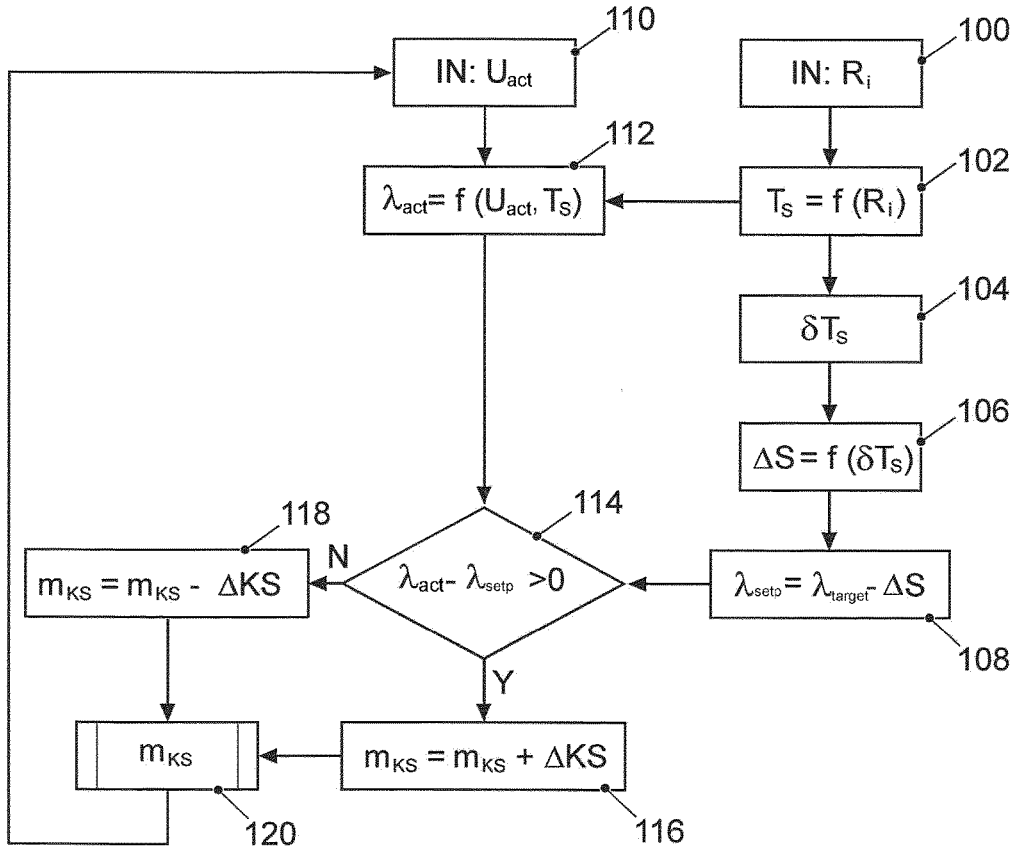
FIG. 2 shows a flowchart of a method sequence for carrying out mixture enrichment in order to protect components against overheating.

The method illustrated in FIG. 2 assumes a state in which the temperature $T_M$ (see FIG. 1) of a component, for example of inlet valves or outlet valves of the engine 10 or of an exhaust gas turbocharger or of the catalytic converter 20, exceeds a permissible temperature and therefore the execution of mixture enrichment for the purpose of protecting components is required.

The method starts in step 100 where, for the purpose of detecting the temperature of the lambda probe 22, the internal resistance $R_i$ of the measuring element of the probe 22 is input. In the subsequent step 102, the sensor temperature $T_S$ of the probe 22 is determined as a function of the internal resistance $R_i$. For this purpose, it is possible to have recourse for instance to a characteristic curve which maps the probe temperature $T_S$ as a function of the internal resistance $R_i$. Such a method for determining the probe temperature is known, for example, from DE 100 36 129 A1. However, within the scope of the present invention, it is, of course, also possible to use other methods for determining the probe temperature.

Figure 3:
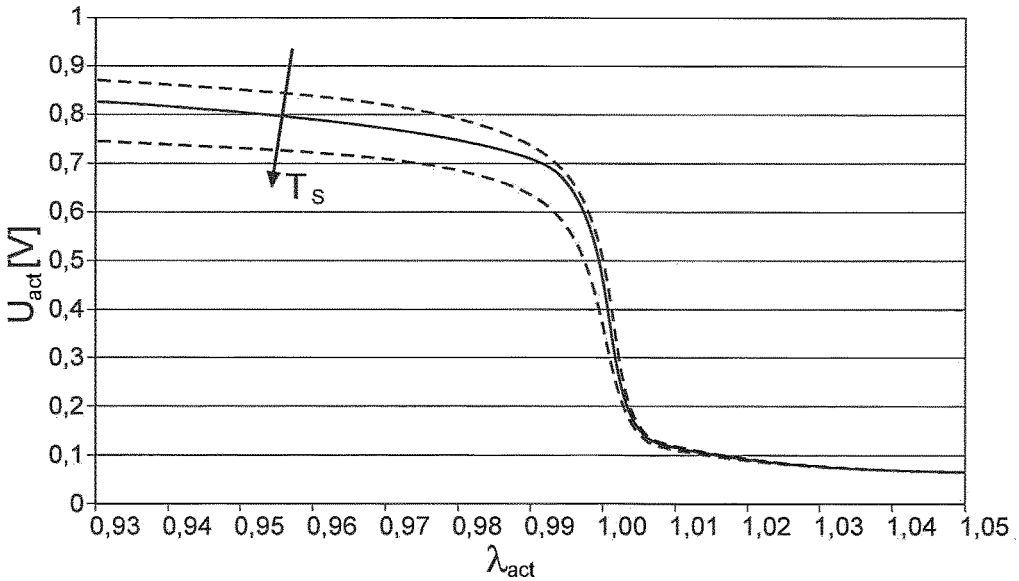
FIG. 3 shows characteristic curves of a step-change lambda probe for various temperatures.

In a parallel (or subsequent) method strand, the probe signal $U_{act}$, dependent on the exhaust gas composition, of the lambda probe 22 is input. Subsequently, in step 112 the exhaust gas composition, in particular the actual lambda value $\lambda_{act}$, is determined as a function of the probe signal $U_{act}$ and of the probe temperature $T_S$ determined in step 102. For this purpose, it is possible to have recourse to a stored characteristic diagram which maps the lambda value $\lambda_{act}$ as a function of the probe signal $U_{act}$ and of the probe temperature $T_S$. FIG. 3 shows by way of example such a characteristic diagram in which the characteristic curves of the step-change lambda probe are represented for three different probe temperatures $T_S$. It is apparent that, in particular, for rich lambda values $\lambda_{act}<1$, the probe voltage $U_{act}$ depends strongly on the temperature.

In a step 104, which is subsequent to step 102, according to the invention, a current accuracy level of the interference variable comprising the probe temperature $\Delta T_S$ or of a current influence of this interference variable on the probe signal $U_{act}$ is evaluated. For example, at this point the variance of the measured resistance value $\delta R_i$ or of the probe temperature $\delta T_S$ which is derived therefrom can be determined in a predetermined preceding time period. Further refinements of the evaluation taking place in step 104 have already been explained above. In a subsequent step 106, the safety interval $\Delta S$ is determined as a function of the variance $\delta T_S$, determined in step 104, of the probe temperature, wherein a larger value is selected for the safety interval $\Delta S$ the larger the variance $\delta T_S$ of the probe temperature. Here, for example a linear relationship can be used.

The method then goes to step 108, where a setpoint value for the predefined lambda value $\lambda_{setp}$ for the mixture enrichment for the purpose of protecting components is defined. In particular, in step 108 the previously determined safety interval $\Delta S$ is subtracted from the predefined lambda target value $\lambda_{target}$ which is to be complied with for protection of the components. If the predefined target value $\lambda_{target}$ for protecting components is, for example, 0.9 and if a safety interval $\Delta S$ of 0.02 was determined in step 106, a predefined lambda setpoint value $\lambda_{setp}$ of 0.88 results. In contrast to the embodiment described above, the lambda deviation $\Delta S$ can, of course, also be a factor which is multiplied by the predefined lambda target value.

In the now subsequent steps 114 to 120, the air/fuel mixture which is to be fed into the internal combustion engine 10 is regulated in accordance with the predefined lambda setpoint value $\lambda_{setp}$ which is determined in step 108, as is generally known in the prior art. For this purpose, in step 114 an interrogation occurs in which the actual lambda value $\lambda_{act}$ which was determined in step 112 is compared with the setpoint lambda value $\lambda_{setp}$ which was determined in step 108. In particular, in step 114 it is possible to check whether the difference $\lambda_{act}-\lambda_{setp}>0$. If this interrogation receives a positive response, i.e. the current lambda value is larger (more lean) than desired, the method goes to step 116 where a quantity of fuel $m_{KS}$ which is fed into the internal combustion engine 10 is increased by a predetermined increment of the quantity of fuel $\Delta KS$ in order to bring about enrichment of the air/fuel mixture. On the other hand, if the interrogation in step 114 receives a negative response, that is to say the actual lambda value $\lambda_{act}$ is smaller (richer) than the setpoint lambda value $\lambda_{setp}$, the method goes to step 118, where the quantity of fuel $m_{KS}$ is reduced by a corresponding increment ΔKS in order to bring about adjustment of the engine in the lean direction. In step 120, the fuel is fed into the internal combustion engine 10 in accordance with the quantity of fuel $m_{KS}$ which was determined in step 116 or 118.

The method then goes back to step 110 in order to detect the probe signal $U_{act}$ again, to determine the actual lambda value $\lambda_{act}$ as a function of the probe signal $U_{act}$ in step 112, and to compare the actual lambda value $\lambda_{act}$ again with the predefined setpoint value $\lambda_{setp}$ in step 114. This cycle is repeated during the entire measure for protecting components until the component temperature $T_M$ has reached a permissible value. The interrogation cycle for checking the component temperature $T_M$ is not illustrated in FIG. 2.

In this context it is possible, but not necessary, that the steps 104 to 108 are carried out at every pass, since a change in the safety interval ΔS and therefore in the setpoint lambda value $\lambda_{setp}$ does not usually change in the short term. In contrast, it is appropriate to carry out the steps 100 and 102 for determining the probe temperature $T_S$ in every interrogation cycle, particularly in the case of mixture enrichment in order to protect components, since here it is to be expected that the temperature of the sensor will also drop.

In the method sequence illustrated in FIG. 2, the safety interval ΔS is applied to the target lambda value $\lambda_{target}$ in order to define in this way the setpoint lambda value $\lambda_{setp}$ of the lambda control process. However, it is, of course, possible, in contrast with this example, to apply a corresponding safety interval ΔS also to the characteristic curve applied in step 112 in order to adapt it in such a way that lambda variation which reflects the uncertainty of the determination of the temperature is taken into account. Alternatively, it is also possible to determine the actual lambda value $\lambda_{act}$, determined in step 112, in the way described above and to apply the safety interval ΔS to the actual lambda value $\lambda_{act}$ determined in this way. All of these variants are to be considered as equivalent.

In one preferred refinement of the invention, the safety interval ΔS is additionally made dependent on the absolute value assumed by the current setpoint lambda value of the engine. In this way it is possible to take into account the fact that many interference variables acquire influence in certain ranges. For example, the probe temperature $T_S$ influences the characteristic curve characteristics significantly more in the case of rich lambda values than in the case of lean ones (see FIG. 3). As a result, the function, applied in step 106 in FIG. 2, for determining the safety interval ΔS can take into account the current lambda value in such a way that the safety interval ΔS is made larger as the lambda values become smaller.

Whereas it was illustrated with respect to FIG. 2 how the probe temperature $T_S$ is taken into account as an interference variable in the detection of lambda, this can alternatively or additionally also take place for the interference variable of the aging of the lambda probe 22. For this purpose, the aging of the lambda probe 22 is detected, for example, by means of the lambda probe 24 which is connected downstream (see FIG. 1) and which functions here as a reference probe. In particular, a deviation from the mean mixture value can be determined by means of the signal of the broadband lambda probe 24, and the characteristic curve of the lambda probe 22 can be correspondingly corrected. Corresponding methods for taking into account such aging effects and for correcting the characteristic curve are known in the prior art. Other methods for determining an aging correction value can also be applied within the scope of the present invention.

According to the invention, an evaluation is now performed, on the basis of the aging correction value determined in this way, as to which inaccuracies can result during the conversion of the probe signal $U_{act}$ into the actual lambda value $\lambda_{act}$ aging of the exhaust gas probe despite the characteristic curve correction. If the probe 22 is, for example, not yet aged at all and if the conversion rule or characteristic curve which is used in step 112 is correctly stored, there will be virtually no deviation of the actual value, determined in step 112, from an actual lambda value. As a result, there is no need for correction of the target lambda value $\lambda_{target}$ which is to be adjusted for protection of the components. As a result, the safety interval ΔS in step 106 can, in an extreme case, be set equal to zero.

In contrast, in the case of aging of the lambda probe 22 and associated correction of the probe characteristic curve an aging correction value will occur. On the basis of the magnitude of this correction value, the invention now evaluates, for example, what tolerance can still remain in the determined actual lambda value despite characteristic curve correction. As a function of this, the safety interval ΔS, that is to say the enrichment which is additionally necessary for protection of the components, is defined.

In a further refinement, influences which cannot be explicitly quantified with evaluation variables but which can nevertheless have a disruptive influence on the determination of lambda are taken into account. In particular, the influence of the operating point of the internal combustion engine 10 can be evaluated here, for example by determining an additional safety interval as a function of the operating point from a rotational speed/load characteristic diagram.

The particular advantage of the method according to the invention can therefore be considered that a saving in fuel is achieved for the statistical majority of probes which have no aging, or only a small degree of aging, and for the majority of operating conditions under which the influence of signal-falsifying interference variables is low. This is achieved in that the full theoretically possible tolerance range of the measurement error is not taken into account in a global fashion, but instead the tolerance range which is actually necessary is always taken into account.

LIST OF REFERENCE NUMERALS

10 Internal combustion engine
12 Fuel injection system
14 Intake system
16 Actuating element
18 Exhaust gas duct
20 Catalytic converter
22 Exhaust gas probe/lambda probe
24 Exhaust gas probe
26 Engine controller
28 Regulating device

The invention claimed is:

1. A method for regulating an air/fuel ratio of an internal combustion engine, comprising:

determining a composition of an exhaust gas of the internal combustion engine by detecting an actual probe signal of the exhaust gas by means of an exhaust gas probe, and by applying a characteristic curve or a calculation rule expressing the exhaust gas composition as a function of the actual probe signal using a regulating device, wherein the determined exhaust gas composition has a lambda value, comparing the lambda value of the determined exhaust gas composition with a setpoint value or a threshold value, influencing the air/fuel ratio fed to the internal combustion engine, when the lambda value of the determined exhaust gas composition reaches or exceeds the setpoint value or the threshold value, defining a safety interval (ΔS) to take into account at least one interference variable which effects a deviation of the lambda value of the determined exhaust gas composition from a lambda value of an exact exhaust gas composition by acting on the actual probe signal, wherein the safety interval (ΔS) ensures that the lambda value of the exact exhaust gas composition is lower than a target lambda value, and applying the safety interval (ΔS) to the characteristic curve, to the calculation rule or to the actual probe signal or defining the setpoint value or threshold value for the exhaust gas composition as a function of the target lambda value and the safety interval, evaluating a current accuracy level of at least one of the at least one interference variable and a current influence of the at least one interference variable on the probe signal, and defining the safety interval (ΔS), which is conditioned by the at least one interference variable, as a function of the evaluation.

2. The method as claimed in claim 1, wherein the interference variable comprises at least one of the following: temperature of the exhaust gas probe, aging of the exhaust gas probe and chemical contamination of the exhaust gas probe.

3. The method as claimed in claim 1, wherein evaluating the current accuracy level of the at least one interference variable, comprises determining a variance of detected values of the interference variable in a preceding time period, and defining the safety interval (ΔS) as a function of the variance.

4. The method as claimed in claim 1, wherein evaluating the current accuracy level of the at least one interference variable, comprises determining a period that has passed since a preceding calibration of a detection system for the interference variable, and defining the safety interval (ΔS) as a function of the period.

5. The method as claimed in claim 1, wherein evaluating the current influence of the at least one interference variable on the probe signal, comprises determining an absolute magnitude of the currently detected interference variable, and defining the safety interval (ΔS) as a function of the absolute magnitude.

6. The method as claimed in claim 1, wherein the setpoint value or threshold value is a predefined lambda value for mixture enrichment in order to protect components against overheating.

7. The method as claimed in claim 1, wherein the setpoint value comprises a predefined lambda value which is to be adjusted within the scope of a lambda control process.

8. The method as claimed in claim 1 further comprising defining the safety interval (ΔS) as a function of an operating point of the internal combustion engine.

9. The method as claimed in claim 8 wherein the operating point of the internal combustion engine is an engine speed and/or an engine load.

10. The method as claimed in claim 1, wherein the exhaust gas probe is a lambda probe.

11. The method as claimed in claim 10, wherein the lambda probe is a step-change lambda probe.

12. A regulating device for regulating an air/fuel ratio of an internal combustion engine, the device configured to carry out the method as claimed in claim 1.

13. A method for regulating an air/fuel ratio of an internal combustion engine, comprising:

determining a composition of an exhaust gas of the internal combustion engine by detecting an actual probe signal of the exhaust gas by means of an exhaust gas probe, and by applying a characteristic curve or a calculation rule expressing the exhaust gas composition as a function of the actual probe signal using a regulating device, defining a safety interval (AS) to take into account at least one interference variable acting on the actual probe signal and applying the safety interval (AS) to the characteristic curve or calculation rule, to the actual probe signal or to a setpoint value or threshold value for the exhaust gas composition, evaluating a current accuracy level of at least one of the at least one interference variable and a current influence of the at least one interference variable on the probe signal, wherein evaluating the current accuracy level of the at least one interference variable comprises determining a period that has passed since a preceding calibration of a detection system for the interference variable, defining the safety interval (AS), which is conditioned by the at least one interference variable, as a function of the evaluation and of the period, comparing the determined exhaust gas composition with the setpoint value or a threshold value, and influencing the air/fuel ratio fed to the internal combustion engine, when the determined exhaust gas composition reaches or exceeds the setpoint value or the threshold value.

14. The method as claimed in claim 13, wherein the interference variable comprises at least one of the following: temperature of the exhaust gas probe, aging of the exhaust gas probe and chemical contamination of the exhaust gas probe.

15. The method as claimed in claim 13, wherein evaluating the current accuracy level of the at least one interference variable, comprises determining a variance of detected values of the interference variable in a preceding time period, and defining the safety interval (ΔS) as a function of the variance.

16. The method as claimed in claim 13, wherein evaluating the current influence of the at least one interference variable on the probe signal, comprises determining an absolute magnitude of the currently detected interference variable, and defining the safety interval (ΔS) as a function of the absolute magnitude.

17. The method as claimed in claim 13, wherein the setpoint value or threshold value is a predefined lambda value for mixture enrichment in order to protect components against overheating.

18. The method as claimed in claim 13, wherein the setpoint value comprises a predefined lambda value which is to be adjusted within the scope of a lambda control process.

19. The method as claimed in claim 13 further comprising defining the safety interval (ΔS) as a function of an operating point of the internal combustion engine.

20. The method as claimed in claim 13, wherein the exhaust gas probe is a lambda probe.

* * * * *